US010754270B2

(12) United States Patent
Kitada et al.

(10) Patent No.: US 10,754,270 B2
(45) Date of Patent: Aug. 25, 2020

(54) TONER, PRODUCTION METHOD OF TONER, IMAGE FORMING METHOD, IMAGE FORMING APPARATUS, AND PROCESS CARTRIDGE

(71) Applicants: Naoko Kitada, Shizuoka (JP); Satoshi Ogawa, Nara (JP); Yoshitaka Sekiguchi, Shizuoka (JP); Masayuki Ishii, Shizuoka (JP); Shohta Kobayashi, Shizuoka (JP)

(72) Inventors: Naoko Kitada, Shizuoka (JP); Satoshi Ogawa, Nara (JP); Yoshitaka Sekiguchi, Shizuoka (JP); Masayuki Ishii, Shizuoka (JP); Shohta Kobayashi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/492,818

(22) PCT Filed: Feb. 15, 2018

(86) PCT No.: PCT/JP2018/005299
§ 371 (c)(1),
(2) Date: Sep. 10, 2019

(87) PCT Pub. No.: WO2018/168312
PCT Pub. Date: Sep. 20, 2018

(65) Prior Publication Data

US 2020/0174390 A1 Jun. 4, 2020

(30) Foreign Application Priority Data

Mar. 17, 2017 (JP) ..... 2017-053250

(51) Int. Cl.
*G03G 9/08* (2006.01)
*G03G 9/097* (2006.01)
(Continued)

(52) U.S. Cl.
CPC ..... *G03G 9/09783* (2013.01); *G03G 9/081* (2013.01); *G03G 9/0815* (2013.01);
(Continued)

(58) Field of Classification Search
CPC ..... G03G 9/0815; G03G 9/0819
(Continued)

(56) References Cited

U.S. PATENT DOCUMENTS 5,714,294 A 2/1998 Maruta et al.
2007/0275315 A1 11/2007 Nagatomo et al.
(Continued)

FOREIGN PATENT DOCUMENTS

EP 0737899 A1 10/1996
JP 2006-139051 A 6/2006
JP 2009-025749 A 2/2009

OTHER PUBLICATIONS

International Search Report dated Apr. 24, 2018 for counterpart International Patent Application No. PCT/JP2018/005299 filed Feb. 15, 2018.
(Continued)

*Primary Examiner* — Mark A Chapman
(74) *Attorney, Agent, or Firm* — Oblon, McClelland, Maier & Neustadt, L.L.P.

(57) ABSTRACT

Provided is a toner including a binder resin, and a charge-controlling agent, wherein a volume average particle diameter X of the toner after a stress treatment satisfies Formula (1), and an amount Y of fine toner particles having particle diameters of 3 micrometers or smaller and circularity of 0.70 or less satisfies Formula (2).

9 Claims, 3 Drawing Sheets

(51) Int. Cl.
*G03G 9/087* (2006.01)
*G03G 21/18* (2006.01)
*G03G 15/08* (2006.01)

(52) U.S. Cl.
CPC ..... *G03G 9/0817* (2013.01); *G03G 9/0819* (2013.01); *G03G 9/08755* (2013.01); *G03G 15/08* (2013.01); *G03G 21/1803* (2013.01)

(58) Field of Classification Search
USPC ..... 430/110.1, 137.1
See application file for complete search history.

(56) References Cited

U.S. PATENT DOCUMENTS

| | | | |
|---|---|---|---|
| 2008/0227009 | A1 | 9/2008 | Fuwa et al. |
| 2009/0029280 | A1 | 1/2009 | Yamamoto et al. |
| 2009/0068579 | A1 | 3/2009 | Ogawa et al. |
| 2009/0074467 | A1 | 3/2009 | Seshita et al. |
| 2009/0233218 | A1 | 9/2009 | Ogawa |
| 2010/0291481 | A1 | 11/2010 | Yamada et al. |
| 2013/0344433 | A1 | 12/2013 | Casalmir et al. |
| 2016/0327884 | A1 | 11/2016 | Nakajima et al. |

OTHER PUBLICATIONS

Written Opinion dated Apr. 24, 2018 for counterpart International Patent Application No. PCT/JP2018/005299 filed Feb. 15, 2018.

[Fig. 1]
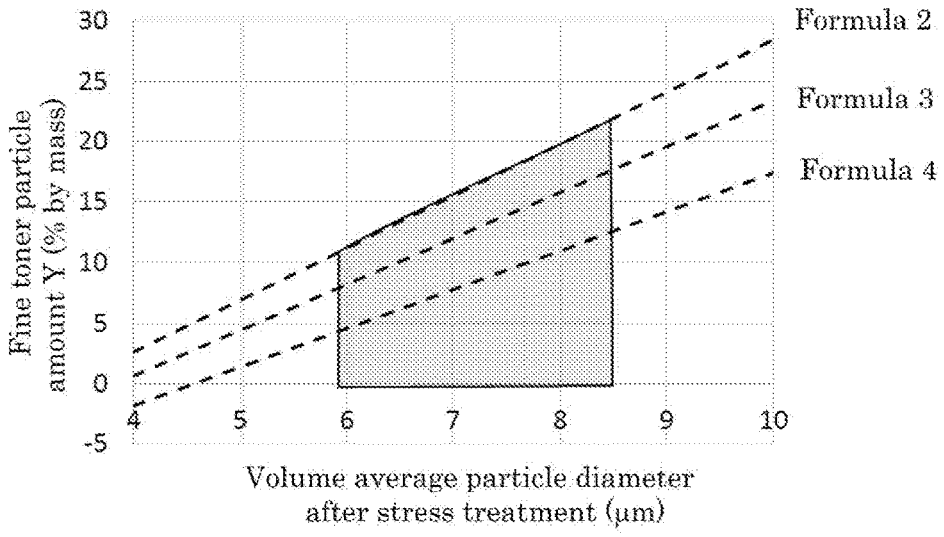
[Fig. 2]
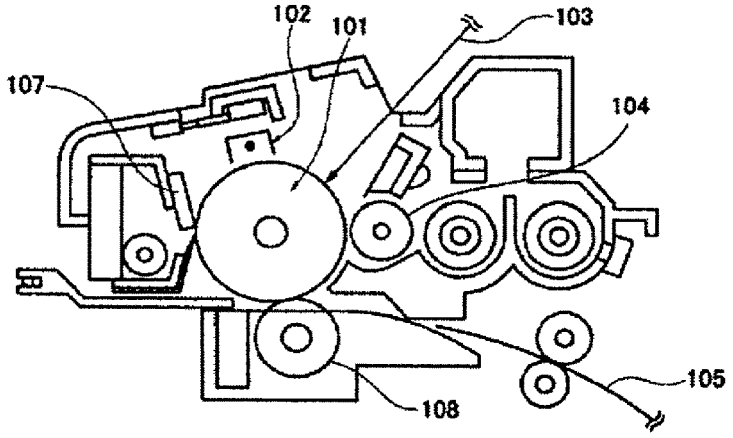
[Fig. 3]
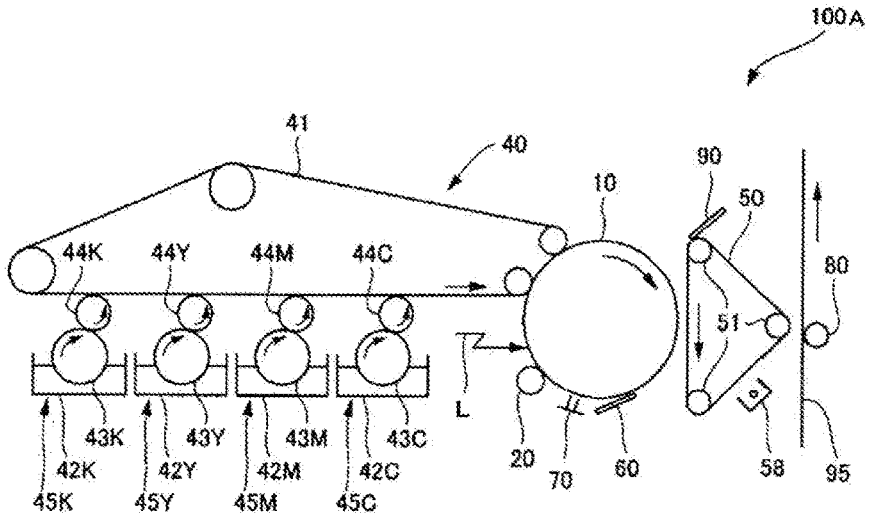

[Fig. 4]
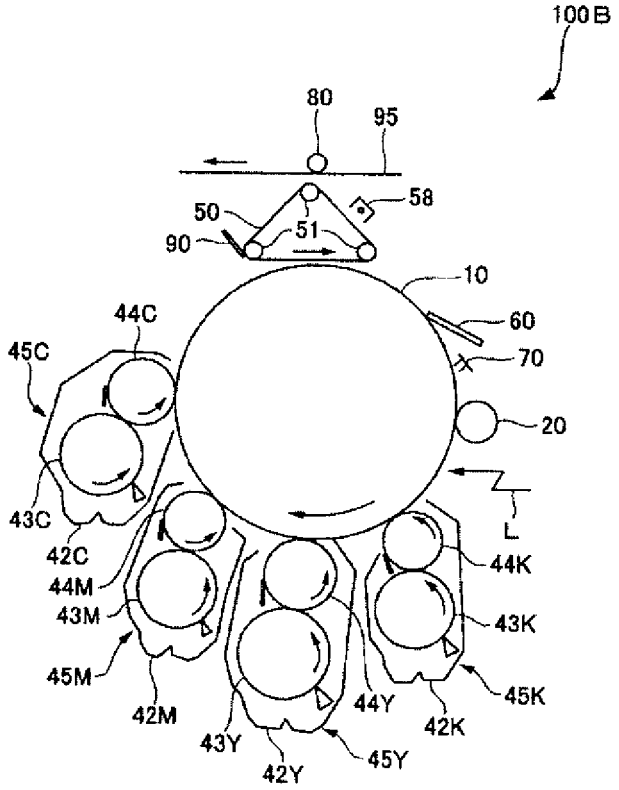

[Fig. 5]
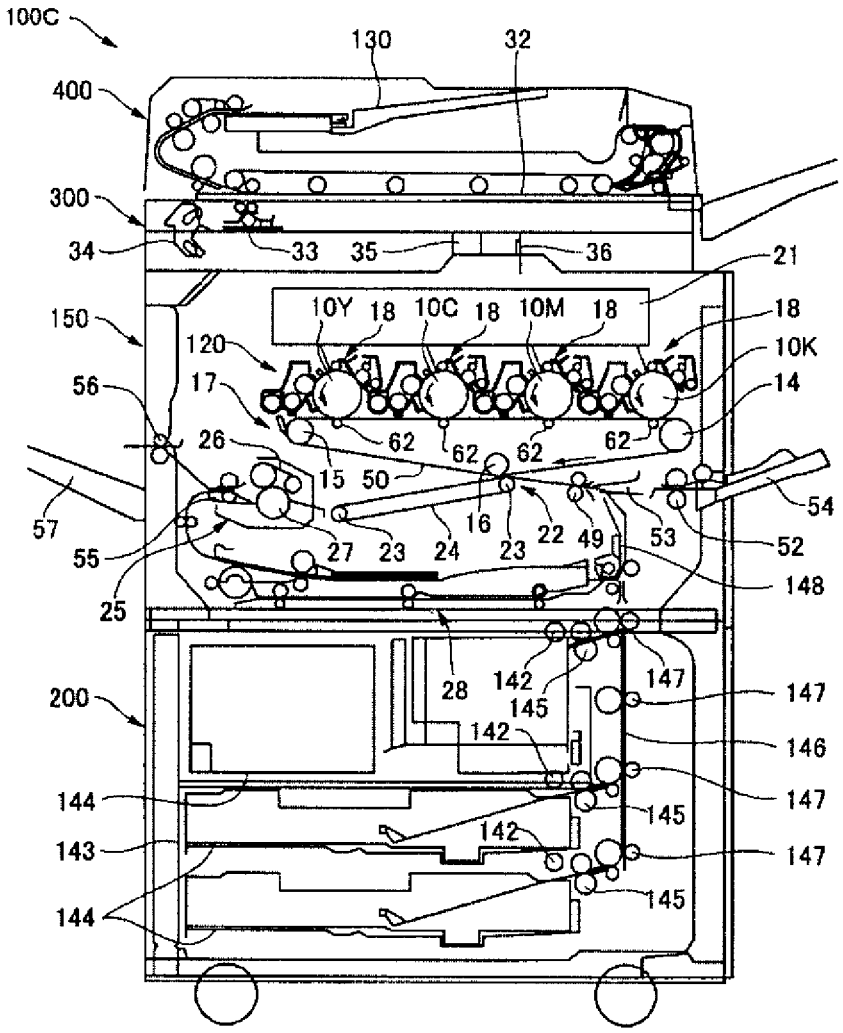
[Fig. 6]
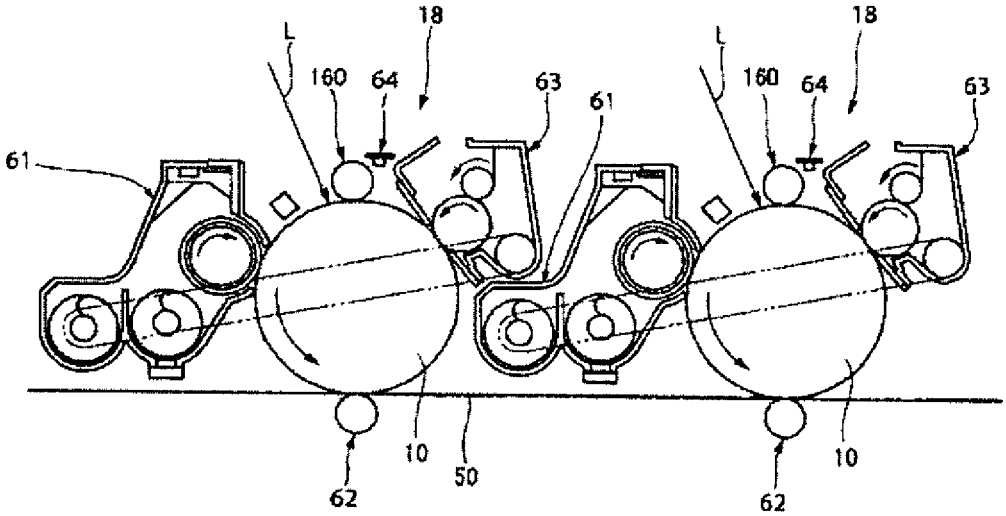

TONER, PRODUCTION METHOD OF TONER, IMAGE FORMING METHOD, IMAGE FORMING APPARATUS, AND PROCESS CARTRIDGE

TECHNICAL FIELD

The present disclosure relates to a toner, a production method of the toner, an image forming method, an image forming apparatus, and a process cartridge.

BACKGROUND ART

One-component development is performed by pressing a supply roller etc. against a developing roller to supply a toner on the developing roller, making the toner to be electrostatically held on the developing roller, forming the toner into a thin layer with a regulating blade, friction-charging the toner, and supplying the toner to a photoconductor to develop with the toner. One-component development can realize downsize in weight and cost saving compared to two-component development or magnetic one-component development.

Moreover, sizes of particles of a toner obtained by pulverization have been reduced in order to improve image quality and therefore there is a need for homogeneously disperse a colorant, a charge-controlling agent, or a release agent in a thermoplastic resin. When dispersion is insufficient, the colorant, charge-controlling agent, or release agent added to the toner comes at an outer surface of the toner particle in the process of pulverization. As a result, irregular-shape toner particles having a low average circularity are generated in a very fine powder region having particle diameters of 3 micrometers or smaller. When toner particles are observed per single particle, moreover, there are problems, such as variations in amounts of raw materials contained in the toner particle, and an increase in an amount of the raw materials exposing to a surface of the toner particle. Accordingly, toner-charging failures occur due to unevenness of the toner particles, and problems, such as conveying failures and deterioration in image quality due to background smear, occur.

In order to solve the above-described problems, proposed are to regulate a ratio of toner particles having the low average circularity or an abundance ratio of toner particles having different circularity to a certain range, to control an abundance of very fine powder region (3 micrometers or smaller) to a certain value or lower, and to control shapes of toner particles in the very fine powder region.

For example, PTL 1 (Japanese Unexamined Patent Application Publication No.

2009-25749) discloses a toner for the purpose of providing a toner having excellent flowability and capable of forming a high quality image of high definition and high resolution, a production method of the toner, a two-component developer, a developing device, and an image forming apparatus. The toner includes at least a binder resin and a colorant. The toner includes a particle group of a large particle diameter and a particle group of a small particle diameter. A volume average particle diameter of the small particle diameter-particle group is smaller than a volume average particle diameter of the large particle diameter-particle group. A volume average particle diameter $D_{50V}$ a cumulative volume of which from the large particle diameter side in a cumulative volume distribution is 50% is 4 micrometers or greater but 8 micrometers or smaller. An amount of toner particles having a volume average particle diameter of 7 micrometers or greater is 24% by volume or greater but 47% by volume or less. An amount of toner particles having a number average particle diameter of 5 micrometers or less is 10% by number or greater but 50% by number or less.

Moreover, PTL 2 (Japanese Unexamined Patent Application Publication No. 2006-139051) discloses a toner used for a two-component developer including a silicone-coated carrier and the toner for the purpose of providing an excellent electrostatic latent image-developing toner and two-component developer where a charge-controlling agent is securely fixed on surfaces of particles of the toner even when the low-fixing toner is used, fogging caused particularly by a difference in a charge amount between the toner in the developer and the supply toner is prevented, and deterioration of the developer is prevented. The toner includes toner base particles each including at least a binder resin, a colorant, and a release agent, a charge-controlling agent, and inorganic particles. When the toner is supplied, an average circularity of the toner measured by a flow particle image analyzer is 0.930 through 0.965 and an amount of fine particles of 3 micrometers or smaller is 5% by number through 20% by number. After the toner is supplied, an amount of fine particles of 3 micrometers or smaller in the toner in a developing device is 5% by number through 70% by number.

CITATION LIST

Patent Literature

[PTL 1] Japanese Unexamined Patent Application Publication No. 2009-25749

[PTL 2] Japanese Unexamined Patent Application Publication No. 2006-139051

SUMMARY OF INVENTION

Technical Problem

The present disclosure has an object to provide a toner which has excellent fixing ability (low-temperature fixing ability and hot offset resistance) and can prevent deterioration of image quality caused by background smear even after the toner receives stress.

Solution to Problem

According to one aspect of the present disclosure, a toner includes a binder resin and a charge-controlling agent. A volume average particle diameter X of the toner after a stress treatment below satisfies Formula (1) below. An amount Y of fine toner particles having particle diameters of 3 micrometers or smaller and circularity of 0.70 or less satisfies Formula (2) below.

$$6.0 \leq X(\text{micrometers}) \leq 8.5 \quad \text{Formula (1)}$$

$$Y(\%\text{ by mass}) \leq 4.3X(\text{micrometers}) - 14.6 \quad \text{Formula (2)}$$

The stress treatment includes charging a container formed of polypropylene having a volume of 100 mL with 5 g of the toner and 10 g of alumina beads having particle diameters of 0.5 mm, and shaking the toner by shaking the container using a shaker (YS-8D, available from YAYOI Co., Ltd.) with a stroke width of 80 mm, a stroke number of 250 times/min, and a shaking duration of 1 hour.

Advantageous Effects of Invention

The present disclosure can provide a toner which has excellent fixing ability (low-temperature fixing ability and hot offset resistance) and can prevent deterioration of image quality caused by background smear even after the toner receives stress.

BRIEF DESCRIPTION OF DRAWINGS

FIG. 1 is a graph depicting a relationship between a volume average particle diameter X of a toner after a stress treatment and an amount Y of fine toner particles.

FIG. 2 is a view for describing one embodiment of a process cartridge of the present disclosure.

FIG. 3 is a view for describing one embodiment of an image forming apparatus of the present disclosure.

FIG. 4 is a view for describing another embodiment of the image forming apparatus of the present disclosure.

FIG. 5 is a view for describing another embodiment of the image forming apparatus of the present disclosure.

FIG. 6 is a view for describing an image forming unit.

DESCRIPTION OF EMBODIMENTS

It cannot be said that toners available in the art have yet sufficiently solved a problem associated with deterioration of image quality caused by background smear.

Moreover, there is no suggestion in the art for a problem of background sear or deterioration of image quality caused by a toner after receiving stress.

Accordingly, the present disclosure has an object to provide a toner which has excellent fixing ability (low-temperature fixing ability and hot offset resistance) and can prevent deterioration of image quality caused by background smear even after the toner receives stress.

Embodiments of a toner of the present disclosure, a production method of the toner, an image forming method, an image forming apparatus, and a process cartridge will be more specifically described hereinafter.

A toner of the present disclosure includes a binder resin and a charge-controlling agent. A volume average particle diameter X of the toner after a stress treatment satisfies Formula (1) below, and an amount Y of fine toner particles having particle diameters of 3 micrometers or smaller and circularity of 0.70 or less satisfies Formula (2) below.

$$6.0 \leq X(\text{micrometers}) \leq 8.5 \quad \text{Formula (1)}$$

$$Y(\%\text{ by mass}) \leq 4.3X(\text{micrometers}) - 14.6 \quad \text{Formula (2)}$$

The present inventors have found that fixing ability of a toner improved and background smear can be prevented even after the toner receives stress when a volume average particle diameter X of the toner after a stress treatment and an amount of the toner belongs to an ultra-fine powder region and irregularly shaped, i.e., an amount Y of fine toner particles having particle diameters of 3 micrometers or smaller and circularity of 0.70 or less, are specified.

When the volume average particle diameter X of the toner after a stress treatment is smaller than 6.0 micrometers, an amount of exposed surface of toner base particles increases, the toner particles tend to aggregate, and therefore white-missing spots in a solid image are formed in terms of image quality. When the volume average particle diameter X is greater than 8.5 micrometers, on the other hand, image quality in terms of dot reproducibility or fine line reproducibility is deteriorated.

The volume average particle diameter X of the toner after a stress treatment is more preferably 6.5 micrometers or greater but 8.0 micrometers or smaller.

When the amount of the toner belongs to an ultrafine powder region and irregularly shaped, i.e., an amount Y of fine toner particles having particle diameters of 3 micrometers or smaller and circularity of 0.70 or less, is greater than the value of Formula (2), moreover, background smear occurs. The reason for occurrence of background smear is assumed as follows. Compared to spherical toner particles, irregular-shape toner particles have a large contact area with an electrostatic latent image bearer, such as a photoconductor and an amount of raw materials exposed to surfaces of toner base particles increases. Therefore, non-electrostatic adhesion of the toner to the photoconductor increases. Moreover, charge tends to be held in cavities of irregular-shape toner particles. Therefore, it is also considered that the photoconductor and projected portions of the irregular-shape toner particles are strongly adhered with electrostatic Coulomb force.

In the present disclosure, moreover, as well as the volume average particles X after the stress treatment satisfies Formula (1), the fine toner particle amount Y preferably satisfies Formula (3) below and more preferably satisfies Formula (4) below in view of an improvement of an effect obtainable by the present disclosure.

$$Y(\%\text{ by mass}) \leq 3.8X(\text{micrometers}) - 14.6 \quad \text{Formula (3)}$$

$$Y(\%\text{ by mass}) \leq 3.2X(\text{micrometers}) - 14.6 \quad \text{Formula (4)}$$

As the stress test for use in the present disclosure, the following treatment method is used in order to give a similar level of stress to stress applied in an actual device for evaluation.

Stress treatment: a container formed of polypropylene having a volume of 100 mL is charged with 5 g of the toner and 10 g of alumina beads having particle diameters of 0.5 mm and the toner is shaken by shaking the container using a shaker (YS-8D, available from YAYOI Co., Ltd.) with a stroke width of 80 mm, a stroke number of 250 times/min, and a shaking duration of 1 hour.

Under the treatment conditions having weaker stress than the above-described stress conditions, chipping or cracking of a toner is less likely to occur and stress applied is not similar to stress applied in an actual device. Therefore, an influence by the presence of an ultra-fine powder region cannot be confirmed.

Under the treatment conditions having stronger stress than the above-described stress conditions, stress stronger than stress applied in an actual device is applied to the toner. Therefore, an influence by the presence of an ultra-fine powder region cannot be confirmed.

Moreover, the toner of the present disclosure preferably includes a tetrahydrofuran (THF)-insoluble component in an amount of 10% by mass through 40% by mass. In a molecular-weight distribution of a THF-soluble component of the toner obtained by gel permeation chromatography (GPC), the toner preferably has a main peak between 10,000 and 16,000, and a molecular weight of a half-value width of the main peak is preferably 60,000 through 90,000. Within the THF-soluble component of the toner, a component having a molecular weight of 2,000 or less as determined by GPC is preferably from 15.0% by mass through 25.0% by mass and a component having a molecular weight of 100,000 or greater as determined by GPC is preferably 10.0% by mass or less.

Hot offset resistance can be improved by adjusting the THF-insoluble component to the range of 10% by mass through 40% by mass, namely making an absolute value of the THF-insoluble component of the toner smaller than an absolute value of the THF-soluble component.

Since the toner preferably has a main peak between 10,000 and 16,000 in the molecular-weight distribution of a THF-soluble component of the toner obtained by GPC, chipping or cracking of the toner can be prevented and moreover low-temperature fixing ability is improved.

When a half-value width of the main peak is molecular weight of less than 60,000, moreover, cracking or chipping of the toner may occur. When the half-value width of the main peak is molecular weight of greater than 90,000, low-temperature fixing ability may be deteriorated. Since a component having a molecular weight of 2,000 or less as determined by GPC is from 15.0% by mass through 25.0% by mass and a component having a molecular weight of 100,000 or greater as determined by GPC is 10.0% by mass or less within the THF-soluble component of the toner, low-temperature fixing ability is improved.

Next, materials used for the toner of the present disclosure will be described.

A binder resin for use in the present disclosure is not particularly limited, but the binder resin is preferably a polyester resin. The polyester resin is typically obtained through condensation polymerization between alcohol and carboxylic acid.

Examples of the alcohol include: glycols, such as ethylene glycol, diethylene glycol, triethylene glycol, and propylene glycol; etherified bisphenols, such as 1.4-bis(hydroxymethyl)cyclohexane and bisphenol A; other divalent alcohol monomers; and trivalent or higher polyvalent alcohol monomers.

Moreover, examples of the carboxylic acid include: divalent organic acid monomers, such as maleic acid, fumaric acid, phthalic acid, isophthalic acid, terephthalic acid, succinic acid, and malonic acid; and trivalent or higher polyvalent carboxylic acid monomers, such as 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane, and 1,2,7,8-octanetetracarboxylic acid.

In view of thermal storage stability, the polyester resin is preferably a polyester resin having glass transition temperature Tg of 55 degrees Celsius or higher, more preferably a polyester resin having glass transition temperature Tg of 60 degrees Celsius or higher.

As described above, the polyester resin is preferably used as a resin component in the toner. Other resins may be used in combination as long as such resins do not adversely affect performance of the toner.

Examples of usable resins other than the polyester resin include the following resins.

Namely, examples of the usable resins include: styrene-based resins (homopolymers or copolymers including styrene or substituted styrene) such as polystyrene, chloropolystyrene, poly-alpha-methylstyrene, styrene/chlorostyrene copolymers, styrene/propylene copolymers, styrene/butadiene copolymers, styrene/vinyl chloride copolymers, styrene/vinyl acetate copolymers, styrene/maleic acid copolymers, styrene/acrylic acid ester copolymers (e.g., styrene/methyl acrylate copolymers, styrene/ethyl acrylate copolymers, styrene/butyl acrylate copolymers, styrene/octyl acrylate copolymers, and styrene/phenyl acrylate copolymers), styrene/methacrylic acid ester copolymers (e.g., styrene/methyl methacrylate copolymers, styrene/ethyl methacrylate copolymers, styrene/butyl methacrylate copolymers, and styrene/phenyl methacrylate copolymers), styrene/methyl alpha-chloroacrylate copolymers, and styrene/acrylonitrile/acrylic acid ester copolymers; vinyl chloride resins; styrene/vinyl acetate copolymers; rosin-modified maleic acid resins; phenol resins; epoxy resins; polyethylene resins; polypropylene resins; ionomer resins; polyurethane resins; silicone resins; ketone resins; ethylene/ethyl acrylate copolymers; xylene resins; polyvinyl butyral resins; petroleum-based resins; and hydrogenated petroleum-based resins.

Production methods of the above-listed resins are not particularly limited, any of bulk polymerization, solution polymerization, emulsion polymerization, or suspension polymerization can be used.

Similarly to the polyester resin, moreover, glass transition temperature Tg of any of the resins above is preferably 55 degrees Celsius or higher and more preferably 60 degrees Celsius or higher, in view of thermal storage stability.

As a charge-controlling agent for use in the present disclosure, any charge-controlling agents known in the art, such as nigrosine dyes, metal complex salt dyes, and salicylic acid metal complexes, can be used alone or in combination. The charge-controlling agent is preferably a metal complex having trivalent or higher metal that may have a 6-coordination structure. Examples of the metal include Al, Fe, Cr, and Zr. Among the metal complex having trivalent or higher metal that may have a 6-coordination structure, a metal complex having Fe having no toxicity as a central metal is preferable. In the present disclosure, an amount of the charge-controlling agent is preferably 0.5 parts by mass or greater but 3.0 parts by mass or less relative to 100 parts by mass of the binder resin. When the amount of the charge-controlling agent is less than 0.5 parts by mass, a function of the charge-controlling agent is not sufficiently exhibited. When the amount of the charge-controlling agent is greater than 3.0 parts by mass, grindability of the toner is affected, hence blade adherence or filming on a photoconductor may be caused. Moreover, charging failures may be caused, and such a charging failure may be a cause for low image quality, such as toner supply failures and background smear. A more preferable amount of the charge-controlling agent is 1 part by mass or greater but 2.5 parts by mass or less relative to 100 parts by mass of the binder resin.

The charge-controlling agent for use in the present disclosure is preferably azo iron dyes represented by Structural Formula (1) below and/or Structural Formula (2) below because of excellent stress resistance.

[Chem. 1]

Structural Formula (1)

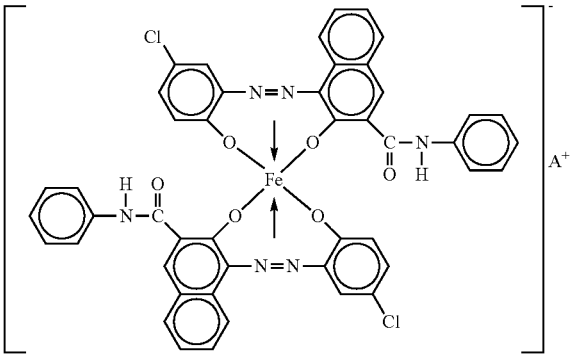

In Structural Formula (1), $A^+$ is an ammonium ion.

[Chem. 2]

Structural Formula (2)

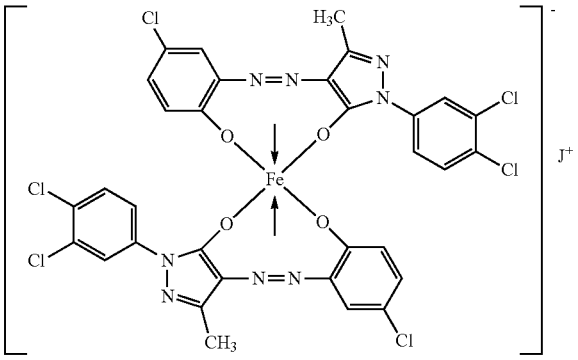

In Structural Formula (2), $J^+$ is H, an alkali metal, ammonium, alkyl ammonium ion, or a mixture of two or more of the above-listed substances.

Among the above-listed examples, the azo iron dye represented by Structural Formula (1) having appropriate charging ability and a high effect of improving background smear is preferably used.

The azo iron dye represented by Structural Formula (1) is available as T-77 and the azo iron dye represented by Structural Formula (2) is available as T-159 from Hodogaya Chemical Co., Ltd.

Examples of other preferable charge-controlling agents include zirconium salicylates. Zirconium salicylates are available from Hodogaya Chemical Co., Ltd.

As a colorant for use in the toner of the present disclosure, any dyes and pigments known in the art can be used alone or in combination. Examples of the dyes and pigments include carbon black, lamp black, iron black, aniline blue, phthalocyanine blue, phthalocyanine green, Hanza Yellow G, Rhodamine 6C lake, Calco Oil Blue, chrome yellow, quinacridone, benzidine yellow, rose bengal, and triallyl methane-based dyes. The toner can be used as a black color or full-color toners.

An amount of the colorant added is, for example, 1% by mass through 30% by mass and preferably 3% by mass through 20% by mass relative to the binder resin.

As a release agent for use in the toner of the present disclosure, any release agents known in the art can be used. Particularly, free fatty-acid carnauba wax, montan wax, and oxidized rice wax can be used alone or in combination.

The carnauba wax is suitably microcrystalline carnauba wax. The carnauba was is preferably carnauba wax having an acid value of 5 or less and gives particle diameters of 1 micrometer or smaller when the carnauba wax is dispersed in a toner binder.

The montan wax means montan-based wax typically refined from minerals. Similarly to the carnauba wax, the montan wax is preferably microcrystalline and preferably has an acid value of 5 through 14.

The oxidized rice wax is wax obtained by oxidizing rice bran wax in the air and preferably has an acid value of 10 through 30.

As other release agents, any of release agents known in the art, such as solid silicone varnish, higher fatty acid higher alcohol, montan-based ester wax, and low-molecular-weight polypropylene wax, can be used in combination.

An amount of the release agent(s) is, for example, 1 part by mass through 20 parts by mass and more preferably 2 parts by mass through 10 parts by mass relative to 100 parts by mass of the binder resin.

<Physical Properties Measuring Methods>

The above-mentioned various physical properties are measured in the following manner.

Volume Average Particle Diameter

A volume average particle diameter is determined by performing a measurement by means of a particle-size analyzer ("Multisizer III," available from Beckman Coulter, Inc.) with an aperture diameter of 100 micrometers and analyzing using an analysis software (Beckman Coulter Mutlisizer 3, Version 3.51).

To 100 mL through 150 mL of an electrolyte aqueous solution, 0.1 mL through 5 mL of a 10% by mass surfactant (alkylbenzene sulfonate) is added. The electrolyte aqueous solution is an about 1% NaCl aqueous solution prepared by using first grade sodium chloride. For example, ISOTON-II (available from Beckman Coulter, Inc.) can be used as the electrolyte aqueous solution. Subsequently, a measuring sample in an amount of 2 mg through 20 mg based on a solid content is added to the electrolyte aqueous solution, the resultant is dispersed for about 1 minute to about 3 minutes by means of an ultrasonic disperser, and then a volume average particle diameter is measured by means of the analysis device with an aperture of 100 micrometers.

Circularity and Fine Toner Particle Amount

A measurement is performed using a flow particle image analyzer (FPIA-3000, available from SYSMEX CORPORATION) and an analysis is performed using an analysis software. A sample is prepared for a measurement by adding 0.1 mL through 5 mL of a 10% by mass surfactant (alkylbenzene sulfonate) to about 50 mg of the toner and diluting the resultant with 50 cc of ion-exchanged water to adjust a measurement concentration (count number) to 8,000 through 12,000. The circularity used in the present disclosure is an average circularity. As the fine toner particle amount, an amount (% by number) of particles having particle diameters of 3.00 micrometers or smaller is calculated.

Molecular Weight Measurement (GPC)

A molecular weight is measured by gel permeation chromatography (GPC) under the following conditions.

Device: GPC-150C (available from WATERS)

Column: KF801 to 807 (available from SHODEX)

Temperature: 40 degrees Celsius

Solvent: tetrahydrofuran (THF)

Flow rate: 1.0 mL/min

Sample: A sample having a concentration of 0.05% through 0.6% in an amount of 0.1 mL is injected.

A number average molecular weight and a weight average molecular weight of the resin are calculated from a molecular weight distribution of the resin measured under the above-described conditions using a molecular-weight calibration curve prepared from monodisperse polystyrene standard samples.

As for the polystyrene standard samples for preparing the calibration curve, Showdex STANDARD Std. Nos. S-7300, S-210, S-390, S-875, S-1980, S-10.9, S-629, S-3.0, and S-0.580 available from SHOWA DENKO K.K. and toluene are used. As the detector, a refractive index (RI) detector is used.

THF-Soluble Component and THF-Insoluble Component

A toner is weighed by about 50 mg. To the toner, 10 g of THF is added to prepare a sufficiently dissolved toner solution. After separating through centrifugation, a supernatant liquid is dried and a solid content of the supernatant liquid is calculated. The result is determined as a THF-soluble component. The value obtained by subtracting the THF-soluble component from a solid content of the entire toner is determined as a THF-insoluble component.

A production method of the toner of the present disclosure includes a melt-kneading step, a pulverizing step, and a classifying step. The melt-kneading step includes kneading toner materials with melting the toner materials to obtain a melt-kneaded product. The pulverizing step includes pulverizing the obtained melt-kneaded product to obtain a pulverized product. The classifying step includes classifying the pulverized product obtained by the pulverizing. A volume average particle diameter X of the toner after a stress treatment below satisfies Formula (1), and an amount Y of fine toner particles having particle diameters of 3 micrometers or smaller and circularity of 0.70 or less satisfies Formula (2).

In the melt-kneading, the toner materials are mixed, a melt-kneader is charged with the mixture to perform melt kneading. As the melt-kneader, for example, a single-screw or twin-screw continuous kneader, or a batch-type kneader using a roll mill can be used. For example, KTK twin-screw extruder available from Kobe Steel, Ltd., TEM twin-screw kneader available from TOSHIBA MACHINE CO., LTD., a mortar extruder available from KCK, PCM twin-screw extruder available from IKEGAI, and a co-kneader available from BUSS are suitably used. The melt kneading is preferably performed under appropriate conditions not to cut molecular chains of the binder resin. Specifically, the melt-kneading temperature is determined with reference to a softening point of the binder resin. When the melt-kneading temperature is excessively lower than the softening point, chain scission occurs significantly. When the melt-kneading temperature is too high, chain scission does not occur and therefore dispersion may not be progressed.

In the pulverizing step, the kneaded product obtained by the kneading is pulverized. In the pulverization, it is preferable that the kneaded product be roughly pulverized first, and then finely pulverized. At the time of the pulverization, a system where pulverization is performed by making the kneaded product crush into an impact board in a jet flow, particles are made crushed with each other in a jet flow to pulverize, or the kneaded product is pulverized with a narrow gap between a mechanically-rotating rotor and a stator.

The classifying step is to classify the pulverized product obtained by the pulverization to adjust to particles having the predetermined particle diameters. The classification can be performed by removing fine particle component by a cyclone, a decanter, or a centrifuge separator.

After completing the pulverizing step and the classifying step, the pulverized product is classified in an air flow by a centrifugal force etc., to thereby produce toner base particles having the predetermined particle diameters. Subsequently, external additives are optionally added to the toner base particles. The toner base particles and the external additives are mixed and stirred by a mixer to cover surfaces of the toner base particles with the external additive while crushing the external additives.

In order to achieve the characteristics of the present disclosure, "a volume average particle diameter X of the toner after a stress treatment satisfies Formula (1), and an amount Y of fine toner particles having particle diameters of 3 micrometers or smaller and circularity of 0.70 or less satisfies Formula (2)," an amount of fine particles of 3 micrometers or smaller itself may be reduced or circularity of the fine particles can be adjusted to be outside the range of 0.70 or less. As a method for reducing the amount of fine particles, there is a method where two-stage classification or TTSP separator (available from HOSOKAWA MICRON CORPORATION) where rotors are arranged in series are used. In order to increase circularity of fine particles, moreover, the adjustment can be achieved by circulating the toner in the pulverizing step through an increase in blower pressure or an increase in rotational speed using a rotor pulverizer.

Moreover, circularity can be also increased by performing pulverization several time at low rotational speed with a closed channel by means of a mechanical pulverizer.

Typically, one-component development tends to easily apply stress to a toner and therefore the above-described problem of deterioration of image quality due to background smear is caused. The toner of the present disclosure can prevent deterioration of image quality even after the toner receives stress, and therefore the toner is particularly useful as a toner for one-component development.

(Image Forming Method and Image Forming Apparatus)

An image forming method of the present disclosure includes forming an image by one-component development. The image forming method includes at least an electrostatic latent image-forming step and a developing step, and may further include other steps, such as a charge-eliminating step, a cleaning step, a recycling step, and a controlling step, according to the necessity.

An image forming apparatus of the present disclosure includes at least an electrostatic-latent-image bearer (may be referred to as a "photoconductor" hereinafter), an electrostatic latent image-forming unit configured to form an electrostatic latent image on the photoconductor, and a developing unit configured to develop the electrostatic latent image with a developer including a toner to form a visible image. The image forming apparatus may further include other units, such as a charge-eliminating unit, a cleaning unit, a recycling unit, and a controlling unit, according to the necessity.

The image forming method is preferably performed by the image forming apparatus. The electrostatic latent image-forming step can be preferably performed by the electrostatic latent image-forming unit, the developing step is preferably performed by the developing unit, and the above-mentioned other steps are preferably performed by the above-mentioned other units.

Electrostatic Latent Image-Forming Step and Electrostatic Latent Image-Forming Unit The electrostatic latent image-forming step is a step including forming an electrostatic latent image on an electrostatic-latent-image bearer.

A material, shape, structure, size, etc. of the electrostatic-latent-image bearer (may be also referred to as "electrophotographic photoconductor" or "photoconductor") are not particularly limited and may be appropriately selected from materials, shapes, structures, sizes, etc., known in the art. A preferable example of the shape of the photoconductor is a drum shape. Examples of the material of the photoconductor include: inorganic photoconductors, such as amorphous silicon and selenium, and organic photoconductors (OPC), such as polysilane, and phthalopolymethine. Among the above-listed examples, an organic photoconductor (OPC) is preferable because an image of higher resolution can be obtained.

For example, formation of the electrostatic latent image can be performed by uniformly charging a surface of the electrostatic-latent-image bearer, followed by exposing the surface of the electrostatic-latent-image bearer with light imagewise. The formation of the electrostatic latent image can be performed by an electrostatic latent image-forming unit.

For example, the electrostatic latent image-forming unit includes at least a charging unit (charger) configured to uniformly charge a surface of the electrostatic-latent-image bearer, and an exposing unit (exposure device) configured to expose the surface of the electrostatic-latent-image bearer to light imagewise.

For example, the charging can be performed by applying voltage to a surface of the electrostatic-latent-image bearer using the charger.

The charger is not particularly limited and may be appropriately selected depending on the intended purpose. Examples of the charger include a contact charger, known in the art as itself, equipped with an electroconductive or semiconductive roller, brush, film, or rubber blade, and a non-contact charger utilizing corona discharge, such as corotron, and scorotron.

The charger is preferably a charger that is disposed in contact with or without contact with the electrostatic-latent-image bearer and is configured to superimpose DC voltage and AC voltage to charge a surface of the electrostatic-latent-image bearer.

Moreover, the charger is preferably a charging roller disposed adjacent to the electrostatic-latent-image bearer via a gap tape without being in contact with the electrostatic-latent-image bearer, where a surface of the electrostatic-latent-image bearer is charged by applying superimposed DC and AC voltage to the charging roller.

The exposure can be performed by exposing the surface of the electrostatic-latent-image bearer to light imagewise using the exposure device.

The exposure device is not particularly limited as long as the exposure device can expose a surface of the electrostatic-latent-image bearer charged by the charger to light that is in the shape of an image to be formed. The exposure device may be appropriately selected depending on the intended purpose. Examples of the exposure device includes various exposure devices, such as a reproduction optical exposure device, a rod-lens array exposure device, a laser optical exposure device, and a liquid crystal shutter optical device.

In the present disclosure, a back light system where exposure is performed imagewise from a back side of the electrostatic-latent-image bearer may be employed.

Developing Step and Developing Unit

The developing step is a step including developing the electrostatic latent image with the toner to form a visible image.

For example, formation of the visible image can be performed by developing the electrostatic latent image with the toner and can be performed by the developing unit.

For example, the developing unit is preferably a developing unit that stores the toner and includes at least a developing device capable of applying the toner to the electrostatic latent image in contact with the electrostatic latent image or without being in contact with the electrostatic latent image. The developing unit is more preferably a developing device equipped with a toner stored container.

The developing device may be a developing device for a single color or a developing device for multiple colors. Preferable examples of the developing device include a developing device including a stirrer configured to stir the toner to cause frictions to charge the toner, and a rotatable magnetic roller.

Inside the developing device, for example, the toner and the carrier are mixed and stirred to cause frictions, the toner is charged by the frictions, and the charged toner is held on a surface of the rotating magnetic roller in the form of a brush to thereby form a magnetic brush. Since the magnet roller is disposed adjacent to the electrostatic-latent-image bearer (photoconductor), part of the toner constituting the magnetic brush formed on the surface of the magnetic roller is transferred onto a surface of the electrostatic-latent-image bearer (photoconductor) by electric suction force. As a result, the electrostatic latent image is developed with the toner to form a visible image formed of the toner on the surface of the electrostatic-latent-image bearer (photoconductor).

Transferring Step and Transferring Unit

The transferring step is a step including transferring the visible image to a recording medium. A preferable embodiment of the transferring step is a step using an intermediate transfer member and including primary transferring a visible image onto the intermediate transfer member, followed by secondary transferring the visible image onto the recording medium. A more preferable embodiment of the transferring step is a step using, as the toner, toners of two or more colors, preferably full-color toners, and including a primary transferring step including transferring visible images onto an intermediate transfer member to form a composite transfer image, and a secondary transferring step including transferring the composite transfer image onto a recording medium.

The transfer can be performed by charging the visible image on the electrostatic-latent-image bearer (photoconductor) using a transfer charger. The transfer can be performed by the transfer unit. A preferable embodiment of the transferring unit is a transferring unit including a primary transferring unit configured to transfer visible images onto an intermediate transfer member to form a composite transfer image and a secondary transferring unit configured to transfer the composite transfer image onto a recording medium.

Note that, the intermediate transfer member is not particularly limited and may be appropriately selected from transfer members known in the art depending on the intended purpose. Preferable examples of the intermediate transfer member include a transfer belt.

The transferring unit (the primary transferring unit or the secondary transferring unit) preferably includes at least a transferring device configured to charge the visible image formed on the electrostatic-latent-image bearer (photoconductor) to release the visible image to the side of the recording medium. The number of the transferring device disposed may be one, or 2 or more.

Examples of the transferring device include a corona transfer device using corona discharge, a transfer belt, a transfer roller, a pressure-transfer roller, and an adhesion-transfer device.

Note that, the recording medium is not particularly limited and may be appropriately selected from recording media (recording paper) known in the art.

Fixing Step and Fixing Unit

The fixing step is a step including fixing the transferred visible image onto the recording medium using a fixing device. The fixing step may be performed every time when the developer of each color is transferred onto the recording medium, or may be performed once when the developers of all colors are laminated.

The fixing device is not particularly limited and may be appropriately selected depending on the intended purpose.

The fixing device is preferably a heat-press unit. Examples of the heat-press unit include a combination of a heating roller and a press roller, and a combination of a heat roller, a press roller, and an endless belt.

The fixing device is preferably a unit that includes a heating body equipped with a heat generator, a film in contact with the heating body, and a press member pressed against the heating body via the film, and is configured to pass a recording medium on which an unfixed image is formed through between the film and the press member to heat-fixing the image onto the recording medium. Heating performed by the heat-press unit is generally preferably performed at 80 degrees Celsius through 200 degrees Celsius.

In the present disclosure, in combination with or instead of the fixing step and the fixing unit, for example, a photofixing device known in the art may be used depending on the intended purpose.

Other Steps and Other Units

The charge-eliminating step is a step including applying charge-elimination bias to the electrostatic-latent-image bearer to eliminate the charge of the electrostatic-latent-image bearer. The charge-eliminating step is preferably performed by a charge-eliminating unit.

The charge-eliminating unit is not particularly limited as long as the charge-eliminating unit is capable of applying charge-elimination bias to the electrostatic-latent-image bearer. The charge-eliminating unit may be appropriately selected from charge eliminators known in the art. Examples of the charge-eliminating unit include charge-eliminating lamps.

The cleaning step is a step including removing the toner remained on the electrostatic-latent-image bearer. The cleaning step is preferably performed by a cleaning unit.

The cleaning unit is not particularly limited as long as the cleaning unit is capable of removing the toner remained on the electrostatic-latent-image bearer. The cleaning unit is appropriately selected from cleaners known in the art. Preferable examples of the cleaner include magnetic-brush cleaners, electrostatic-brush cleaners, magnetic-roller cleaners, blade cleaners, brush cleaners, and web cleaners.

The recycling step is a step including recycling the toner removed by the cleaning step to the developing unit. The recycling unit is preferably performed by a recycling unit. The recycling unit is not particularly limited. Examples of the recycling unit include conveying units known in the art.

The controlling step is a step including controlling each of the above-described steps. The controlling step is preferably performed by the controlling unit.

The controlling unit is not particularly limited as long as the controlling unit is capable of controlling operations of each of the above-mentioned units. The controlling unit may be appropriately selected depending on the intended purpose. Examples of the controlling unit include devices, such as sequencers and computers.

A first example of the image forming apparatus of the present disclosure is illustrated in FIG. 3. An image forming apparatus 100A includes a photoconductor drum 10, a charging roller 20, an exposing device, a developing device 40, an intermediate transfer belt 50, a cleaning device 60 including a cleaning blade, and a charge-eliminating lamp 70.

The intermediate transfer belt 50 is an endless belt that is supported with three rollers 51 disposed at the inner side of the intermediate transfer belt 50. The intermediate transfer belt 50 can be moved in the direction indicated with an arrow in FIG. 3. Part of the three rollers 51 also functions as a transfer bias roller capable of applying transfer bias (primary transfer bias) to an intermediate transfer belt 50. Moreover, a cleaning device 90 having a cleaning blade is disposed adjacent to the intermediate transfer belt 50. Furthermore, a transfer roller 80 is disposed to face the intermediate transfer belt 50. The transfer roller is capable of applying transfer bias (secondary transfer bias) for transferring a toner image to transfer paper 95.

In the surrounding area of the intermediate transfer belt 50, a corona-charging device 58 configured to apply charge to the toner image transferred to the intermediate transfer belt 50 is disposed between a contact area of the photoconductor drum 10 and the intermediate transfer belt 50 and a contact area of the intermediate transfer belt 50 and the transfer paper 95 relative to a rotational direction of the intermediate transfer belt 50.

The developing device 40 includes a developing belt 41, and a black-developing unit 45K, a yellow-developing unit 45Y, a magenta-developing unit 45M, and a cyan-developing unit 45C disposed in the surrounding area of the developing belt 41. Note that, the developing unit of each color includes a developer-stored unit 42, a developer-supply roller 43, and a developing roller (developer bearer) 44. Moreover, the developing belt 41 is an endless belt supported by a plurality of belt rollers and is rotatable in the direction indicated with the arrow in FIG. 3. Moreover, part of the developing belt 41 is in contact with the photoconductor drum 10.

Next, a method for forming an image using the image forming apparatus 100A will be explained. First, a surface of the photoconductor drum 10 is uniformly charged using the charging roller 20, followed by applying exposure light L to the photoconductor drum 10 using an exposing device (not illustrated) to form an electrostatic latent image. Next, the electrostatic latent image forming on the photoconductor drum 10 is developed with a toner supplied from the developing device 40 to form a toner image. Moreover, the toner image formed on the photoconductor drum 10 is transferred (primary transfer) onto the intermediate transfer belt 50 by transfer bias applied from the roller 51, transferring the toner image (secondary transfer) onto transfer paper 95 by transfer bias applied from the transfer roller 80. Meanwhile, the toner remained on a surface of the photoconductor drum 10, from which the toner image has been transferred to the intermediate transfer belt 50, is removed by the cleaning device 60, followed by eliminating the charge from the surface using the charge-eliminating lamp 70.

A second example of the image forming apparatus for use in the present disclosure is illustrated in FIG. 4. The image forming apparatus 100B has the same structure to the structure of the image forming apparatus 100A, except that the developing belt 41 is not disposed, and the black-developing unit 45K, the yellow-developing unit 45Y, the magenta-developing unit 45M, and the cyan-developing unit 45C are disposed directly facing the perimeter of the photoconductor drum 10.

A third example of the image forming apparatus for use in the present disclosure is illustrated in FIG. 5. An image forming apparatus 100C is a tandem color-image forming apparatus and includes a photocopier main body 150, a paper-feeding table 200, a scanner 300, and an automatic document feeder (ADF) 400.

An intermediate transfer belt 50 disposed in a central area of the photocopier main body 150 is an endless belt supported by three rollers 14, 15, and 16. The intermediate transfer belt 50 can be rotated in the direction indicated with the arrow in FIG. 5. A cleaning device 17 having a cleaning blade configured to remove a toner remained on the intermediate transfer belt 50, from which a toner image has been transferred to recording paper, is disposed adjacent to the roller 15. A yellow electrostatic-latent-image bearer 10Y, a cyan electrostatic-latent-image bearer 10C, a magenta electrostatic-latent-image bearer 10M, and a black electrostatic-latent-image bearer 10K are disposed parallel along the conveying direction, as well as facing the intermediate transfer belt 50 supported by the rollers 14 and 15.

Moreover, an exposing device 21 is disposed adjacent to the image forming unit 120. Furthermore, a secondary-transfer belt 24 is disposed at the side of the intermediate transfer belt 50 opposite to the side where the image forming unit 120 is disposed. Note that, the secondary-transfer belt 24 is an endless belt supported by a pair of rollers 23, and recording paper transported on the secondary-transfer belt 24 and the intermediate transfer belt 50 can be brought into contact with each other between the rollers 16 and 23.

Moreover, a fixing device 25 is disposed adjacent to the secondary-transfer belt 24. The fixing device 25 includes a fixing belt 26 that is an endless belt supported by a pair of rollers, and a press roller 27 disposed to be pressed against the fixing belt 26. Note that, a sheet reverser 28 configured to reverse recording paper when images are formed on both sides of the recording paper is disposed adjacent to the secondary-transfer belt 24 and the fixing device 25.

Next, a method for forming a full-color image using the image forming apparatus 100C will be explained. First, a color document is set on a document table 130 of the automatic document feeder (ADF) 400. Alternatively, the automatic document feeder 400 is opened, a color document is set on a contact glass 32 of a scanner 300 and then the automatic document feeder 400 is closed. In the case where the document is set on the automatic document feeder 400, once a start switch, which is not illustrated, is pressed, the document is transported onto the contact glass 32, and then the scanner 300 is driven to scan the document with a first carriage 33 equipped with a light source and a second carriage 34 equipped with a mirror. In the case where the document is set on the contact glass 32, the scanner 300 is immediately driven in the same manner as mentioned. Light is emitted from the first carriage 33 is reflected from a surface of the document and the reflected light is reflected by the second carriage 34, and then the reflected light is received by a reading sensor 36 via an image forming lens 35 to read the document to thereby obtain image information of black, yellow, magenta, and cyan.

Image information of each color is transmitted to a corresponding image-forming unit 18 of a corresponding image forming unit 120 to form a toner image of each color. As illustrated in FIG. 6, the image forming unit 120 of each color includes a photoconductor drum 10, a charging roller 160 configured to uniformly charge the photoconductor drum 10, an exposing device configured to apply exposure light L to the photoconductor drum 10 based on the image information of each color to form an electrostatic latent image of each color, a developing device 61 configured to develop the electrostatic latent image with a developer of each color to form a toner image of each color, a transfer roller 62 configured to transfer the toner image onto the intermediate transfer belt 50, a cleaning device 63 having a cleaning blade, and a charge-eliminating lamp 64.

The single-color toner images formed by the image forming units 120 of the above-mentioned colors are sequentially transferred (primary transfer) onto the intermediate transfer belt 50 moving with being supported by the rollers 14, 15, and 16 to superimpose the single-color toner images to thereby form a composite toner image.

Meanwhile, one of paper feeding rollers 142 of the paper feeding table 200 is selectively rotated to feed sheets from one of vertically stacked paper feeding cassette 144 housed in a paper bank 143. The sheets are separated one another by a separation roller 145. The separated sheet is fed through a paper feeding path 146, then fed through a paper feeding path 148 in the photocopier main body 150 by conveying with a conveyance roller 147, and is stopped at a registration roller 49. Alternatively, paper feeding rollers are rotated to feed sheets on a bypass feeder 54. The sheets are separated one another by a separation roller 52. The separated sheet is fed through a manual paper feeding path 53, and is stopped at the registration roller 49.

Note that, the registration roller 49 is generally earthed at the time of use, but the registration roller 49 may be used in a state where bias is applied in order to remove paper dusts of recording paper. Next, the registration roller 49 is rotated to synchronously with the movement of the composite toner image formed on the intermediate transfer belt 50, to thereby send the recording paper between the intermediate transfer belt 50 and the secondary-transfer belt 24. The composite toner image is transferred (secondary transfer) on the recording paper. Note that, the toner remained on the intermediate transfer belt 50, from which the composite toner image has been transferred, is removed by the cleaning device 17.

The recording paper, onto which the composite toner image has been transferred, is conveyed by the secondary-transfer belt 24 and then the composite toner image is fixed by the fixing device 25. Next, the traveling path of the recording paper is changed by a switch craw 55 and the recording paper is ejected onto a paper-ejection tray 57 by an ejecting roller 56. Alternatively, the traveling path of the recording paper is changed by the switch craw 55 and the recording paper is reversed by the sheet reverser 28. After forming an image on a back side of the recording paper in the same manner, the recording paper is ejected onto the paper-ejection tray 57 by the ejection roller 56.

In the present disclosure, a toner stored unit is a unit that has a function of storing a toner and stores the toner therein. Examples of an embodiment of the toner stored unit include a toner stored container, a developing device, and a process cartridge.

The toner stored container is a container storing a toner.

The developing device is a developing device including a developing unit storing a toner.

The process cartridge includes at least an electrostatic-latent-image bearer and a developing unit configured to develop an electrostatic latent image formed on the electrostatic-latent-image bearer with a developer to form a visible image. The process cartridge is detachably mounted in a main body of an image forming apparatus. The above-mentioned developer is the toner of the present disclosure. The process cartridge may further includes at least one selected from the group consisting of a charging unit, an exposing unit, and a cleaning unit.

Next, one embodiment of the process cartridge is illustrated in FIG. 2. As illustrated in FIG. 2, the process cartridge of the present embodiment includes an electrostatic-latent-image bearer 101 inside the process cartridge, includes a charging device 102, a developing device 104, and a cleaning unit 107, and may further include other units according to the necessity. In FIG. 2, the reference numeral 103 represents exposure from the exposing device and the reference numeral 105 represents recording paper.

As the electrostatic-latent-image bearer 101, a similar electrostatic-latent-image bearer to the one used in the above-described image forming apparatus can be used. Moreover, an arbitrary charging member is used for the charging device 102.

An image forming process performed by the process cartridge illustrated in FIG. 2 is as follows. While the electrostatic-latent-image bearer 101 is rotated clockwise, an electrostatic latent image corresponding to an exposure image is formed on a surface of the electrostatic-latent-image bearer 101 by performing charging by the charging device 102 and exposure 103 by an exposing unit (not illustrated).

The electrostatic latent image is developed with a toner by the developing device 104, and the toner-developed image is transferred onto recording paper 105 by the transfer roller 108, followed by printing out the recording paper. Subsequently, a surface of the electrostatic-latent-image bearer after the image transfer is cleaned by the cleaning unit 107. Moreover, the charge of the surface of the electrostatic-latent-image bearer is eliminated by a charge-eliminating unit (not illustrated), and then the above-described operation of the image forming process is again repeated.

Since image formation is performed using the toner of the present disclosure by mounting the toner stored unit storing the toner of the present disclosure in the image forming apparatus, adhesion of the toner to a regulating blade is inhibited, cleaning properties are sufficiently secured, and excellent image quality without background smear can be obtained.

EXAMPLES

The present disclosure will be described in more detail by way of the following Examples. However, the present disclosure should not be construed as being limited to these Examples. Note that, "part(s)" mentioned in each Examples or Comparative Example denotes "part(s) by mass" unless otherwise stated.

<Production of Polyester>

A four-necked recovery flask that had a volume of 1 L and was equipped with a thermometer, a stirrer, a condenser, and a nitrogen gas-inlet tube was charged with an acid component and an alcohol component presented in Tables 1 and 2. The flask was set in a heating mantle and the flask was heated in a state where nitrogen gas was introduced into the flask through the nitrogen gas-inlet tube to maintain the inner atmosphere of the flask an inert atmosphere. Subsequently, 0.05 parts by mass of dibutyl tin oxide was added and the mixture inside the flask was allowed to react with maintaining the temperature to 200 degrees Celsius to thereby obtain each polyester. Various physical properties of each polyester are also presented in Tables 1 and 2. Note that, in Tables 1 and 2, the numerical values for the acid component and the alcohol component are represented by "part(s) by mass," "Mw" denotes a weight average molecular weight, and the numerical values for the THF-insoluble component are presented by "%."

TABLE 1

| Polyester resin A | | Resin A-1 | Resin A-2 | Resin A-3 |
|---|---|---|---|---|
| Acid component | terephthalic acid | 25 | 40 | 35 |
| | fumaric acid | 10 | | 30 |
| | succinic acid | 10 | 15 | |
| | trimellitic anhydride | | | |
| Alcohol component | bisphenol A(2.2) propylene oxide | 20 | 35 | 25 |
| | bisphenol A (2.2) ethylene oxide | 40 | 10 | 20 |
| Physical properties | Mw | 35,000 | 60,000 | 42,000 |
| | peak-top molecular weight | 12,000 | 11,000 | 10,800 |
| | THF-insoluble component | 0 | 0 | 0 |

TABLE 2

| Polyester resin B | | Resin B-1 | Resin B-2 | Resin B-3 | Resin B-4 | Resin B-5 |
|---|---|---|---|---|---|---|
| Acid component | terephthalic acid | 22.5 | 15 | 20 | 35 | 22.5 |
| | fumaric acid | 20 | 30 | | 10 | 15 |
| | succinic acid | | | 18 | | |
| | trimellitic anhydride | 20 | 30 | 10 | 35 | 15 |
| Alcohol component | bisphenal A (2.2) propylene oxide | 20 | 30 | 15 | 25 | 30 |
| | bisphenol A (2.2) ethylene oxide | 20 | 15 | 25 | 15 | 15 |
| Physical properties | Mw | 40,000 | 45,000 | 34,000 | 63,200 | 36,000 |
| | peak-top molecular weight | 13,000 | 9,500 | 12,000 | 17,000 | 15,200 |
| | THF-insoluble component | 25 | 38 | 19 | 45 | 10 |

Example 1

Polyester resin A-1: 55.6 parts

Polyester resin B-1: 44.4 parts

Ric wax (TOWAX-3F16, available from TOA KASEI CO., LTD.): 3 parts

Carbon black (#44, available from Mitsubishi Chemical Corporation): 6 parts

Azo iron dye CCA1 (T-77, available from Hodogaya Chemical Co., Ltd.): 1.0 part by mass After sufficiently stirring and mixing a mixture having the composition above in Henschel Mixer, the resultant mixture was melt-kneaded by means of a twin-screw extrusion kneader (TEM-18SS, available from TOSHIBA MACHINE CO., LTD.). After cooling the obtained kneaded product to room temperature, the kneaded product was pulverized and classified by means of a jet mill (IDS-2, available from NIPPON PNEUMATIC MFG. CO., LTD.) and a rotor classifier (50ATP, available from HOSOKAWA MICRON CORPORATION), to thereby obtain toner base particles having a volume average particle diameter of 7.5 micrometers.

To 100 parts by mass of the obtained toner base particles, 2 parts by mass of HMDS-treated hydrophobic silica (RX200, available from NIPPON AEROSIL CO., LTD.) having an average particle diameter of 12 nm to thereby obtain Toner 1. Then, the above-described stress treatment was performed on Toner 1.

The volume average particle diameter X of Toner 1 after the stress treatment was 7.4 micrometers and an amount Y of fine toner particles having particle diameters of 3 micrometers or smaller and circularity of 0.70 or less was 8.6% by mass. Physical properties of the toner are presented in Table 3.

Example 2

Toner 2 was obtained in the same manner as in Example 1, except that Polyester Resin A-1 was changed to Polyester resin A-2, and 1.0 part of CCA1 of the charge-controlling agent was changed to 1.2 parts of CCA1. The volume average particle diameter X of Toner 2 after the stress treatment was 6.1 micrometers and the amount Y of fine toner particles was 0.9% by mass. Physical properties of the toner are presented in Table 3.

Example 3

Toner 3 was obtained in the same manner as in Example 1, except that Polyester Resin A-1 was changed to Polyester Resin A-2, Polyester Resin B-1 was changed to Polyester Resin B-2, and 1.0 part of CCA1 of the charge-controlling agent was changed to 1.5 parts of CCA1. The volume average particle diameter X of Toner 3 after the stress treatment was 8.4 micrometers and the amount Y of fine toner particles was 0.9% by mass. Physical properties of the toner are presented in Table 3.

Example 4

Toner 4 was obtained in the same manner as in Example 1, except that 55.6 parts of Polyester Resin A-1 was changed to 56.3 parts of Polyester Resin A-3, 44.4 parts of Polyester Resin B-1 was changed to 43.7 parts of Polyester Resin B-3, and 1.0 part of CCA1 of the charge-controlling agent was changed to 2.0 parts of CCA1. The volume average particle diameter X of Toner 4 after the stress treatment was 6.1 micrometers and the amount Y of fine toner particles was 11.6% by mass. Physical properties of the toner are presented in Table 3.

Example 5

Toner 5 was obtained in the same manner as in Example 1, except that 55.6 parts of Polyester Resin A-1 was changed to 54.2 parts of Polyester Resin A-3, 44.4 parts of Polyester Resin B-1 was changed to 45.8 parts of Polyester Resin B-3, and 1.0 part of CCA1 of the charge-controlling agent was changed to 1.4 parts of CCA1. The volume average particle diameter X of Toner 5 after the stress treatment was 8.4 micrometers and the amount Y of fine toner particles was 21.5% by mass. Physical properties of the toner are presented in Table 3.

Example 6

Toner 6 was obtained in the same manner as in Example 1, except that 55.6 parts of Polyester Resin A-1 was changed to 56.0 parts, 44.4 parts of Polyester Resin B-1 was changed to 44.0 parts, and 1.0 part of CCA1 of the charge-controlling agent was changed to 1.7 parts of CCA1. The volume average particle diameter X of Toner 6 after the stress treatment was 6.1 micrometers and the amount Y of fine toner particles was 11.6% by mass. Physical properties of the toner are presented in Table 3.

Example 7

Toner 7 was obtained in the same manner as in Example 1, except that 55.6 parts of Polyester Resin A-1 was changed to 54.5 parts and 44.4 parts of Polyester Resin B-1 was changed to 45.5 parts. The volume average particle diameter X of Toner 7 after the stress treatment was 8.4 micrometers and the amount Y of fine toner particles was 21.5% by mass. Physical properties of the toner are presented in Table 3.

Example 8

Toner 8 was obtained in the same manner as in Example 1, except that Polyester Resin B-1 was changed to Polyester Resin B-4 and 1.0 part of CCA1 of the charge-controlling agent was changed to 1.3 parts of CCA1. The volume average particle diameter X of Toner 8 after the stress treatment was 7.4 micrometers and the amount Y of fine toner particles was 16.8% by mass. A THF-insoluble component of Toner 8 was measured and the result was 8.0%. Physical properties of the toner are presented in Table 3.

Example 9

Toner 9 was obtained in the same manner as in Example 1, except that Polyester Resin B-1 was changed to Polyester Resin B-5 and 1.0 part of CCA1 of the charge-controlling agent was changed to 0.9 parts of CCA1. The volume average particle diameter X of Toner 9 after the stress treatment was 7.4 micrometers and the amount Y of fine toner particles was 16.8% by mass. A THF-insoluble component of Toner 9 was measured and the result was 42.0%. Physical properties of the toner are presented in Table 3.

Example 10

Toner 10 was obtained in the same manner as in Example 1, except that 1.0 part of CCA1 of the charge-controlling agent was changed to 0.4 parts of CCA2 (TN-105, available from Hodogaya Chemical Co., Ltd.). The volume average particle diameter X of Toner 10 after the stress treatment was 7.4 micrometers and the amount Y of fine toner particles was 16.8% by mass. Physical properties of the toner are presented in Table 3.

Example 11

Toner 11 was obtained in the same manner as in Example 1, except that 1.0 part of CCA1 of the charge-controlling agent was changed to 3.1 parts of CCA2 (zirconium salicylate, TN-105, available from Hodogaya Chemical Co., Ltd.). The volume average particle diameter X of Toner 11 after the stress treatment was 7.4 micrometers and the amount Y of fine toner particles was 16.8% by mass. Physical properties of the toner are presented in Table 3.

Comparative Example 1

Comparative Toner 1 was obtained in the same manner as in Example 1, except that 55.6 parts of Polyester Resin A-1 was changed to 54.0 parts and 44.4 parts of Polyester Resin B-1 was changed to 46.0 parts. The volume average particle diameter X of Comparative Toner 1 after the stress treatment was 5.9 micrometers and the amount Y of fine toner particles was 0.7% by mass. Physical properties of the toner are presented in Table 3.

Comparative Example 2

In Comparative Example 1, the pulverization classification conditions were changed to give the volume average diameter X after the stress treatment of 8.6 micrometers and the fine toner particle amount Y of 1.2% by mass (Comparative Toner 2). Physical properties of the toner are presented in Table 3.

Comparative Example 3

Comparative Toner 3 was obtained in the same manner as in Example 1, except that 55.6 parts of Polyester Resin A-1 was changed to 57.2 parts and 44.4 parts of Polyester Resin B-1 was changed to 42.8 parts. The volume average particle diameter X of Comparative Toner 3 after the stress treatment was 5.9 micrometers and the amount Y of fine toner particles was 10.6% by mass. Physical properties of the toner are presented in Table 3.

Comparative Example 4

In Comparative Example 3, the pulverization classification conditions were changed to give the volume average diameter X after the stress treatment of 8.6 micrometers and the fine toner particle amount Y of 22.2% by mass (Comparative Toner 4). Physical properties of the toner are presented in Table 3.

Comparative Example 5

Comparative Toner 5 was obtained in the same manner as in Example 1, except that 55.6 parts of Polyester Resin A-1 was changed to 56.5 parts and 44.4 parts of Polyester Resin B-1 was changed to 43.5 parts. The volume average particle diameter X of Comparative Toner 5 after the stress treatment was 6.1 micrometers and the amount Y of fine toner particles was 11.8% by mass. Physical properties of the toner are presented in Table 3.

Comparative Example 6

In Comparative Example 5, the pulverization classification conditions were changed to give the volume average diameter X after the stress treatment of 8.4 micrometers and the fine toner particle amount Y of 22.3% by mass (Comparative Toner 6).

Physical properties of the toner are presented in Table 3.

TABLE 3

| | Resin | | | | Physcal properties of toner | | | |
|---|---|---|---|---|---|---|---|---|
| | Rosin A | | Resin B | | Particle diameter | Fine toner particle amount Y | | |
| | Type | Amount | Type | Amount | X μm | Formula 2 | Formula 3 | Formula 4 |
| Ex. 1 | A-1 | 55.6 | B-1 | 44.4 | 7.4 | satisfied | satisfied | satisfied |
| Ex. 2 | A-2 | 55.6 | B-1 | 44.4 | 6.1 | satisfied | satisfied | satisfied |
| Ex. 3 | A-2 | 55.6 | B-2 | 44.4 | 8.4 | satisfied | satisfied | satisfied |
| Ex. 4 | A-3 | 56.3 | B-3 | 43.7 | 6.1 | satisfied | over upper limit | over upper limit |
| Ex. 5 | A-3 | 64.2 | B-3 | 46.8 | 8.4. | satisfied | over upper limit | over upper limit |
| Ex. 6 | A-1 | 56.0 | B-1 | 44.0 | 6.1 | satisfied | satisfied | over upper limit |
| Ex. 7 | A-1 | 64.6 | B-1 | 48.6 | 8.4 | satisfied | satisfied | over upper limit |
| Ex. 8 | A-1 | 55.6 | B-4 | 44.4 | 7.4 | satisfied | satisfied | satisfied |
| Ex. 9 | A-1 | 65.6 | B-5 | 44.4 | 7.4 | satisfied | satisfied | satisfied |
| Ex. 10 | A-1 | 55.6 | B-1 | 44.4 | 7.4 | satisfied | satisfied | satisfied |
| Ex. 11 | A-1 | 55.6 | B-l | 44.4 | 7.4 | satisfied | satisfied | satisfied |
| Comp. Ex. 1 | A-1 | 54.0 | B-1 | 46.0 | 5.9 | satisfied | satisfied | satisfied |
| Comp. Ex. 2 | A-1 | 54.0 | B-l | 46.0 | 8.6 | satisfied | satisfied | satisfied |
| Comp. Ex. 3 | A-1 | 57.2 | B-l | 42.8 | 5.9 | satisfied | satisfied | satisfied |
| Comp. Ex. 4 | A-1 | 57.2 | B-l | 42.8 | 8.6 | satisfied | satisfied | satisfied |
| Comp. Ex. 5 | A-1 | 56.5 | B-l | 43.6 | 6.1 | over upper limit | over upper limit | over upper limit |
| Comp. Ex. 6 | A-1 | 56.5 | B-l | 43.6 | 8.4 | over upper limit | over upper limit | over upper limit |

| | Physcal properties of toner | | | | | | | |
|---|---|---|---|---|---|---|---|---|
| | THF | THF soluble component (Mw) | | | | Charge-controlling agent | | |
| | insoluble component (mass %) | Main peak molacular weight | Half-value width | Amount of component of 2,000 or less (mass %) | Amount of component of 100.000 or more (mass %) | Azo iron dye | part (a) | |
| Ex. 1 | 26 | 11,700 | 72,600 | 22.3 | 6.1 | CCA1 | 1.0 | Toner 1 |
| Ex. 2 | 26 | 11,700 | 72,600 | 22.3 | 6.1 | CCA1 | 1.2 | Toner 2 |
| Ex. 3 | 35 | 14,200 | 77,400 | 24.0 | 8.6 | CCA1 | 1.5 | Toner 3 |
| Ex. 4 | 18 | 11,050 | 72,200 | 21.8 | 6.3 | CCA1 | 2.0 | Toner 4 |
| Ex. 5 | 24 | 12,100 | 71,800 | 22 | 6.4 | CCA1 | 1.4 | Toner 5 |
| Ex. 6 | 24 | 12,100 | 71,800 | 22 | 6.4 | CCA1 | 1.7 | Toner 6 |
| Ex. 7 | 13 | 11,000 | 69,800 | 18.9 | 6.1 | CCA1 | 1.0 | Toner 7 |
| Ex. 8 | 8 | 9,000 | 55,000 | 14 | 11 | CCA1 | 1.3 | Toner 8 |
| Ex. 9 | 42 | 16,500 | 90,500 | 26 | 11 | CCA1 | 0.9 | Tones 9 |
| Ex. 10 | 26 | 11,700 | 72,600 | 22.3 | 6.1 | CCA2 | 0.4 | Toner 10 |
| Ex. 11 | 26 | 11,700 | 72,600 | 22.3 | 6.1 | CCA2 | 3.1 | Toner 11 |

TABLE 3-continued

| | | | | | | | | |
|---|---|---|---|---|---|---|---|---|
| Comp. Ex. 1 | 26 | 11,700 | 72,000 | 22.3 | 6.1 | CCA1 | 1.0 | Comp. Toner 1 |
| Comp. Ex. 2 | 26 | 11,700 | 72,600 | 22.8 | 6.1 | CCA1 | 1.0 | Comp. Toner 2 |
| Comp. Ex. 3 | 35 | 14,200 | 77,400 | 24.0 | 8.6 | CCA1 | 1.0 | Comp. Toner 3 |
| Comp. Ex. 4 | 35 | 14,200 | 77,400 | 24.0 | 8.6 | CCA1 | 1.0 | Comp. Toner 4 |
| Comp. Ex. 5 | 24 | 11,500 | 71,800 | 22 | 6.4 | CCA1 | 1.0 | Comp. Toner 5 |
| Comp. Ex. 6 | 24 | 11,500 | 71,800 | 22 | 6.4 | CCA1 | 1.0 | Comp. Toner 6 |

The following evaluations were performed on the obtained toners after the stress treatment.

<Evaluation Methods>

1. Fixing Ability (Low-Temperature Fixing Ability)

IPSiO SP C220 available from Ricoh Company Limited was modified and the modified device was charged with the toner. The device was set in a manner that an amount of the toner deposition on Type 6000T paper available from Ricoh Company Limited was to be 10 g/m$^2$, and the paper on which an unfixed square solid image having a side of 40 mm was formed was prepared.

Next, the prepared unfixed solid image was passed through a modified fixing unit of IPSiO SP 4510SF available from Ricoh Company Limited with setting the system speed to 240 mm/sec, to thereby fix the image.

The test was performed by varying the fixing temperature from 120 degrees Celsius through 160 degrees Celsius by 5 degrees Celsius. The output images were visually observed and the temperature at which unintentional toner transfer did not occur on the white background region was determined as the minimum fixing temperature.

A: the minimum fixing temperature was lower than 140 degrees Celsius

B: the minimum fixing temperature was 140 degrees Celsius or higher but lower than 150 degrees Celsius C: the minimum fixing temperature was 150 degrees Celsius or higher but lower than 160 degrees Celsius D: the minimum fixing temperature was 160 degrees Celsius or higher (High-Temperature Release Ability)

IPSiO SP C220 available from Ricoh Company Limited was modified. The modified device was charged with the toner. An unfixed square-solid image having a side of 40 mm was printed on Type 6000T available from Ricoh Company Limited by setting the device in a manner that a deposition amount was to be 10 g/m$^2$.

Next, the prepared unfixed solid image was passed through the modified fixing unit of IPSiO SP 4510SF available from Ricoh Company Limited with setting the system speed to 240 mm/sec to thereby fix the image.

The test was performed by varying the fixing temperature from 160 degrees Celsius through 220 degrees Celsius by 5 degrees Celsius. The output images were visually observed and the temperature at which unintentional toner transfer did not occur on the white background region was determined as the maximum fixing temperature.

A: the maximum fixing temperature was 210 degrees Celsius or higher

B: the maximum fixing temperature was 190 degrees Celsius or higher but lower than 210 degrees Celsius C: the maximum fixing temperature was 170 degrees Celsius or higher but lower than 190 degrees Celsius D: the maximum fixing temperature was lower than 170 degrees Celsius 2. Evaluation of Background Smear IPSiO SP C220 available from Ricoh Company Limited was modified. The modified device was charged with 13.5 g of the above-obtained toner, and SCOTCH TAPE was adhered to an entire surface of an exposed area of a photoconductor operation of which was suspended during printing of a blank sheet. The peeled SCOTCH TAPE was adhered to Type 6000T paper available from Ricoh Company Limited and was then stored.

A value of L* on the tape was measured by X-rite.

A: L* was 91 or greater

B: L* was 89 or greater but less than 91

C: L* was 85 or greater but less than 89

D: L* was less than 85

3. Evaluation of Blade-Adherence Resistance

A developing unit of IPSiO SP C220 available from Ricoh Company Limited was charged with 20 g of the toner and a blade-adherence evaluation was performed by means of an external idle machine. The blade adherence was confirmed every 5 minutes by visually observing lines derived from the adherence in the areas of the developing roller at the image forming section where each area was from each edge of the developing roller to a position that was 5 cm from the edge. Evaluation criteria are as described below.

The following criteria judge the time when blade adherence occurred.

A: 120 minutes or later

B: 60 minutes or later but before 120 minutes

C: 30 minutes or later but before 60 minutes

D: before 30 minutes

4. Image Evaluation

IPSiO SP C220 available from Ricoh Company Limited was modified and the modified device was charged with 13.5 g of the toner. An evaluation image was output and a rank evaluation was performed on the evaluation image according to a criteria sample for white missing spots in a solid image and a criteria sample for dot reproducibility.

A: Rank 4 or higher

B: Rank 3 or higher but lower than Rank 4

C: Rank 2 or higher but lower than Rank 3

D: Lower than Rank 2

The evaluation results are presented in Table 4.

TABLE 4

| | Fixing ability | | | | | |
|---|---|---|---|---|---|---|
| | low temperature fixing ability | | high-temperature release ability | | Background smear | |
| | (° C.) | evaluation | (° C.) | evaluation | L* | evaluation |
| Toner 1 | 138 | A | 220 | A | 93.0 | A |
| Toner 2 | 141 | B | 195 | B | 94.0 | A |
| Toner 3 | 143 | B | 210 | A | 94.5 | A |
| Toner 4 | 148 | B | 215 | A | 88.0 | C |

TABLE 4-continued

| | | | | | | |
|---|---|---|---|---|---|---|
| Toner 5 | 139 | A | 190 | B | 90.0 | B |
| Toner 6 | 150 | C | 210 | A | 90.0 | B |
| Toner 7 | 142 | B | 213 | A | 87.0 | C |
| Toner 8 | 148 | B | 213 | A | 87.0 | C |
| Tones 9 | 153 | C | 209 | B | 86.0 | C |
| Toner 10 | 139 | A | 196 | B | 89.0 | B |
| Toner 11 | 149 | B | 202 | B | 85.0 | C |
| Comp. Toner 1 | 142 | B | 200 | B | 90.0 | B |
| Comp. Toner 2 | 145 | B | 194 | B | 91.0 | A |
| Comp. Toner 3 | 139 | A | 189 | C | 86.0 | C |
| Comp. Toner 4 | 138 | A | 191 | B | 88.0 | C |
| Comp. Toner 5 | 141 | B | 180 | C | 79.0 | D |
| Comp. Toner 6 | 142 | B | 210 | A | 82.0 | D |

| | Blade adherence resistance | | Image evaluation | | | |
|---|---|---|---|---|---|---|
| | evaluation | | white missing spots | | dot reproducibility (fine line) | |
| | time [min] | evaluation | rank | evaluation | rank | evaluation |
| Toner 1 | 120 | A | 5 | A | 3.5 | B |
| Toner 2 | 75 | B | 2.5 | C | 4 | A |
| Toner 3 | 110 | B | 3 | B | 3 | B |
| Toner 4 | 70 | B | 2 | C | 3 | B |
| Toner 5 | 115 | B | 3.5 | B | 2 | C |
| Toner 6 | 115 | B | 2.5 | C | 3.5 | B |
| Toner 7 | 80 | B | 3.5 | B | 3.5 | B |
| Toner 8 | 45 | C | 4 | A | 3 | B |
| Tones 9 | 120 | A | 4.5 | A | 2.5 | C |
| Toner 10 | 50 | C | 4 | A | 3 | B |
| Toner 11 | 120 | A | 2 | C | 3 | B |
| Comp. Toner 1 | 110 | B | 1.5 | D | 3 | B |
| Comp. Toner 2 | 50 | C | 3 | B | 1.5 | D |
| Comp. Toner 3 | 105 | B | 1.5 | D | 2 | C |
| Comp. Toner 4 | 70 | B | 3.5 | B | 1 | D |
| Comp. Toner 5 | 40 | C | 3.5 | B | 3 | B |
| Comp. Toner 6 | 55 | C | 3 | B | 3.5 | B |

It was found from the results of Table 4 that the toner of the present disclosure had excellent fixing ability and could prevent deterioration of image quality due to background smear even after the toner received stress, compared to the comparative toners. FIG. 1 is a graph depicting a relationship between the volume average particle diameter X of the toner after the stress treatment and the fine toner particle amount Y. The area surrounded by the solid line is a range specified by the present disclosure. Examples satisfied Formula 4 exhibited particularly excellent results.

REFERENCE SIGNS LIST

10: electrostatic-latent-image bearer (photoconductor drum)
10K: electrostatic-latent-image bearer for black
10Y: electrostatic-latent-image bearer for yellow
10M: electrostatic-latent-image bearer for magenta
10C: electrostatic-latent-image bearer for cyan
14: roller
15: roller
16: roller
17: cleaning device
18: image-forming unit
20: charging roller
21: exposing device
22: secondary transferring device
23: roller
24: secondary-transfer belt
25: fixing device
26: fixing belt
27: press roller
28: sheet reverser
32: contact glass
33: first carriage
34: second carriage
35: image forming lens
36: reading sensor
40: developing device
41: developing belt
42K: developer-stored unit
42Y: developer-stored unit
42M: developer-stored unit
42C: developer-stored unit
43K: developer-supply roller
43Y: developer-supply roller
43M: developer-supply roller
43C: developer-supply roller
44K: developing roller
44Y: developing roller
44M: developing roller
44C: developing roller
45K: black developing unit
45Y: yellow developing unit
45M: magenta developing unit
45C: cyan developing unit
49: registration roller
50: intermediate transfer belt
51: roller
52: separation roller
53: manual paper feeding path
54: bypass feeder
55: switch craw
56: ejection roller
57: paper ejection tray
58: corona-charging device

60: cleaning device
61: developing device
62: transfer roller
63: cleaning device
64: charge-eliminating lamp
70: charge-eliminating lamp
80: transfer roller
90: cleaning device
95: transfer paper
100A, 100B, 100C: image forming device
101: electrostatic-latent-image bearer
102: charging device
103: exposure from exposing device
104: developing device
105: recording paper
107: cleaning unit
108: transfer roller
120: image forming unit
130: document table
142: paper feeding roller
143: paper bank
144: paper feeding cassette
145: separation roller
146: paper feeding path
147: conveyance roller
148: paper feeding path
150: photocopier main body
160: charging roller
200: paper feeding table
300: scanner
400: automatic document feeder (ADF)

The invention claimed is:

1. A toner comprising:
a binder resin; and
a charge-controlling agent,
wherein a volume average particle diameter X of the toner after a stress treatment below satisfies Formula (1) below, and
an amount Y of fine toner particles having particle diameters of 3 micrometers or smaller and circularity of 0.70 or less satisfies Formula (2) below, $$6.0 \leq X(\text{micrometers}) \leq 8.5 \quad \text{Formula (1)}$$

$$Y(\%\text{ by mass}) \leq 4.3X(\text{micrometers}) - 14.6 \quad \text{Formula (2)}$$

where the stress treatment includes charging a container formed of polypropylene having a volume of 100 mL with 5 g of the toner and 10 g of alumina beads having particle diameters of 0.5 mm, and shaking the toner by shaking the container using a shaker (YS-8D, available from YAYOI Co., Ltd.) with a stroke width of 80 mm, a stroke number of 250 times/min, and a shaking duration of 1 hour.

2. The toner according to claim 1,
wherein the amount Y of the fine toner particles satisfies Formula (3) below, $$Y(\%\text{ by mass}) \leq 3.8X(\text{micrometers}) - 14.6 \quad \text{Formula (3)}$$

3. The toner according to claim 1,
wherein the amount Y of the fine toner particles satisfies Formula (4) below, $$Y(\%\text{ by mass}) \leq 3.2X(\text{micrometers}) - 14.6 \quad \text{Formula (4)}$$

4. The toner according to claim 1,
wherein the charge-controlling agent includes an azo iron dye.

5. The toner according to claim 1,
wherein the toner includes a THF-insoluble component in an amount of 10% by mass through 40% by mass,
a molecular-weight distribution of a THF-soluble component of the toner obtained by gel permeation chromatography (GPC) has a main peak between 10,000 and 16,000, where a half-value width of the main peak is a molecular weight of 60,000 through 90,000, and
within the THF-soluble component of the toner, a component having a molecular weight of 2,000 or less as determined by GPC is from 15.0% by mass through 25.0% by mass and a component having a molecular weight of 100,000 or greater as determined by GPC is 10.0% by mass or less.

6. A toner production method comprising:
kneading toner materials with melting the toner materials to obtain a melt-kneaded product;
pulverizing the melt-kneaded product to obtain a pulverized product; and
classifying the pulverized product obtained by the pulverizing,
wherein the toner production method is a method for producing the toner according to claim 1,
a volume average particle diameter X of the toner after a stress treatment below satisfies Formula (1), and
an amount Y of fine toner particles having particle diameters of 3 micrometers or smaller and circularity of 0.70 or less satisfies Formula (2).

7. An image forming method comprising:
forming an image by one-component development using the toner according to claim 1.

8. An image forming apparatus comprising:
an electrostatic-latent-image bearer;
an electrostatic latent image-forming unit configured to form an electrostatic latent image on the electrostatic-latent-image bearer; and
a developing unit including a developer and configured to develop the electrostatic latent image with the developer to form a visible image,
wherein the developer includes the toner according to claim 1.

9. A process cartridge comprising:
an electrostatic-latent-image bearer; and
a developing unit including a developer and configured to develop an electrostatic latent image formed on the electrostatic-latent-image bearer with the developer to form a visible image,
wherein the process cartridge is detachably mounted in a main body of an image forming apparatus, and
the developer includes the toner according to claim 1.

* * * * *